US011236497B2

(12) United States Patent
Barbara Morfin

(10) Patent No.: US 11,236,497 B2
(45) Date of Patent: Feb. 1, 2022

(54) OUTLET VALVE IN A WATERLESS URINAL FOR AVOIDING THE RETURN OF FOUL ODORS FROM THE DRAINAGE

(71) Applicant: Helvex, S.A. de C.V., Mexico City (MX)

(72) Inventor: Jorge Barbara Morfin, Mexico City (MX)

(73) Assignee: HELVEX, S.A. DE C.V., Mexico City (MX)

( * ) Notice: Subject to any disclaimer, the term of this patent is extended or adjusted under 35 U.S.C. 154(b) by 0 days.

(21) Appl. No.: 16/836,751

(22) Filed: Mar. 31, 2020

(65) Prior Publication Data

US 2021/0222411 A1 Jul. 22, 2021

(30) Foreign Application Priority Data

Jan. 17, 2020 (MX) ..... MX/a/2020/000679

(51) Int. Cl.

| | |
|---|---|
| ***E03C 1/28*** | (2006.01) |
| ***E03C 1/29*** | (2006.01) |
| ***E03C 1/298*** | (2006.01) |
| ***E03D 13/00*** | (2006.01) |

(52) U.S. Cl.

CPC ..... *E03C 1/281* (2013.01); *E03C 1/29* (2013.01); *E03C 1/298* (2013.01); *E03D 13/007* (2013.01)

(58) Field of Classification Search

CPC . E03C 1/281; E03C 1/29; E03C 1/298; E03D 13/007; F16K 15/04

USPC ..... 4/144.1–144.4; 137/202

See application file for complete search history.

(56) References Cited

U.S. PATENT DOCUMENTS

| | | | | |
|---|---|---|---|---|
| 5,711,037 | A | 1/1998 | Reichardt et al. | |
| 6,053,197 | A | 4/2000 | Gorges | |
| 7,111,332 | B1 | 9/2006 | Hsia | |
| 9,222,247 | B2 * | 12/2015 | Muderlak | E03D 13/007 |
| 10,323,396 | B2 | 6/2019 | Villalobos Lopez | |

* cited by examiner

*Primary Examiner* — Tuan N Nguyen

(74) *Attorney, Agent, or Firm* — Hoglund & Pamias, PSC; Roberto J. Rios

(57) ABSTRACT

The valve is applied in the industry of bathroom furniture, the industry of manufacturing urinals or dry urinals that do not drag waste through water. The valve provides a water seal that does not require dragging water; it is the urine itself that achieves the seal without the odor developed by the urine of the water seal returning to the users' space. A seal is provided by spheres avoiding the use of consumables, such as sealing oil, scent pads, among others. An outlet valve is provided, in a waterless urinal, towards the drainage, preventing the return of foul odors, including a hydraulic trap formed by a tank where a certain volume of urine is formed, a funnel that discharges the new urine into the bottom of the tank, and an upper valve where the seal is carried out by one or two spheres in their respective seats.

6 Claims, 3 Drawing Sheets

OUTLET VALVE IN A WATERLESS URINAL FOR AVOIDING THE RETURN OF FOUL ODORS FROM THE DRAINAGE

FIELD OF THE INVENTION

The present invention is directed to the industry of manufacture of bathroom furniture, specifically in the industry of manufacture of urinals or dry urinals, that is in urinals or urinals that do not drag the waste by means of water.

BACKGROUND OF THE INVENTION

U.S. Pat. No. 5,711,037, by Reichardt et al., describes a waterless urinal. The urinal system includes a cartridge odor trap unit configured as a double-chamber coaxial bell trap that eliminates the need for conventional P or J type traps required in water-based urinals. In the odor trap, an oily liquid sealant body, floating on top of a trapped residual urine body, serves as an odor barrier, but allows the urine to immediately penetrate downwards through the sealant and proceeds to a drain without the need for flushing. The odor trap is molded from two pieces of plastic that are assembled together to form a cartridge unit that fits easily into the bowl cavity of the urinal bowl configured for wall mounting. The cartridge stays in place by friction and gravity and can be easily removed with a special tool. A special formulation of low specific gravity sealant, which ensures efficient operation, is made biodegradable to protect the environment from any trace of the formulation escaping into the drain. When required, sealant replacement is easily done. For unusually frequent use, maintenance can be reduced by using an auxiliary oil tank serving one or more urinals.

U.S. Pat. No. 6,053,197 to Gorges, shows a system for the retention of oily liquid sealant in a sealed odor trap for a waterless urinal using oil. This is accomplished by making the liquid flow path substantially horizontal as a deviation from the conventional practice of substantially vertical flow. The trap is structured to make the liquid flow path substantially horizontal and to locate the flow path immediately below the sealant layer or below a portion of the baffle that is tilted so that dispersed sealant droplets migrate upward to the upper surface of the flow path due to their buoyancy. It will be recaptured and returned to the main sealant layer. To achieve a substantially horizontal flow, the inlet compartment can be made to have substantially separated inlet and outlet openings. The baffle between the inlet compartment and the discharge compartment, which has traditionally been made completely vertical, is made to have a non-vertical portion which is preferably inclined to recover the sealant. A sealant protection region can be provided in the vicinity of the inlet region to prevent catastrophic loss of sealant in the event of high-pressure waste discharge.

U.S. Pat. No. 7,111,332 to Hsia, refers to a waterless urinary system that can be flushed with liquid. The system consists of a urinal with a flushing liquid and a urine separator and a flushing liquid recycling system: the urine and flushing liquid separator has three flow barriers that can guide the urine into upward and downward flow paths towards a drain: two of the three flow barriers that can serve as drains: the flushing liquid recycling system can send flushing liquid from the bottom of the urinal to the top of the urinal: the flush fluid recycling system is optionally a foot operated pumping system that optionally has a paddle that connects to a bucket that can be tilted up or down by paddle operations: the foot operated pumping system of the flush fluid recycling system that optionally has two paddles: the flush fluid recycling system is optionally a pump, motor and piping system that has sensors, timer and power control and supply system. From reviewing these prior art patent documents, it can be seen that the water seal can be made with an oily material that is less dense than water. However, this seal tends to be dragged into the drain and even if it is applied in a dry urinal, dragging of the seal still occurs.

There is also the seal carried out by a hose of certain material and conformation that provides an adhesion on the internal walls allowing the flow of water in one direction but avoiding the flow in the opposite direction. This device loses its surface qualities due to the continuous contact with the urine, which gradually destroys the surface adhesion and also forms a layer of incrustations that destroys the adhesion and therefore the seal.

A third type of seal is achieved by spheres that, by their own weight, seal against a seat, preventing foul odors generated by urine from returning to the space where the urinals are installed. The design of the spheres is multifactorial. The size, weight, roughness of the outer wall, the physicochemical characteristics of the wall, chemical and mechanical resistance, among others, are complicated.

These characteristics will determine the behavior of the spheres in their application. For example, the size of the sphere will determine its surface of contact on the seat of the valve and therefore that sealed is developed.

But the weight of the ball itself will determine two aspects of the valve's operation, on the one hand, the speed at which ball floats when a user makes use of the installation and on the other, the force with which this ball seals against the valve seat.

In other words, each characteristic of the ball has its effect on its performance, if the ball is very heavy, it is clear that the sealing is better. However, it is less buoyant and does not allow rapid flow of urine to the bottom of the sealing valve.

OBJECTIVES OF THE INVENTION

The main objective of the present invention is to provide a water seal for dry urinals, in which such a seal does not require water to be drained.

A further objective is to achieve an outlet valve for dry urinals in which the urine itself achieves the seal, but the odor developed by the urine in the water seal does not return to the users' space.

Incorporate the double ball seal to a water seal avoiding the use of consumables in the product, such as sealant oil, scent pads, among others.

Provide a structure that allows easy of disassembly for washing and preventive maintenance, while as a whole, having an aesthetic appearance of the product.

And all those objectives and advantages that will become clear with the reading of this description, accompanied by the accompanying figures.

BRIEF DESCRIPTION OF THE INVENTION

In an activity of continuous improvement, with a Benchmarking process, it was observed that the water seal of immiscible liquid in water being less dense than water, was continuously used the most.

Its application in a dry urinal is completely feasible; however, it had the disadvantage of requiring frequent replacement due to the dragging of this liquid by normal use.

With the physicochemical characteristics of the liquid that forms the seal, the dimensions of the body that contains the liquid in the urinal are specific dimensions. For example, the height of the seal, by having a low density, is relatively large. A water seal of a denser liquid would require a lower height to counteract the pressure generated in the drainage of approximately 5 mbar.

Tests carried out on a dry water seal urinal have shown that the urine itself can stop the odor from draining when the immiscible liquid seal has been exhausted.

However, the urine that forms the seal emanates itself the characteristic odor that is perceived when using sanitation facilities with dry urinals.

Therefore, it became imperative to reinforce the water seal with a seal using a different principle, and a dry urine-sealed outlet valve having hydraulic seal was designed with the urine and a mechanical seal.

That is, a system that has two types of seals. The first one is based on the formation of a column of liquid that retains the regression (counter-pressure) of foul odors from the pipe. The second one consists of mechanical seals consisting of spheres that, by their own weight, seal any foul odor that could be generated by the decomposing liquids housed in the liquid column. When the user's urine enters the upper chamber, the sphere floats by a difference in density allowing the liquid to pass into the hydraulic trap, as the urine is dislodged into the pipe, the spheres reseal maintaining a constant seal without foul odor.

It is clear that the dimensions of this upper chamber allow for efficient evacuation of the urine so that the urine does not accumulate in the urinal.

As the efficiency of a double-sealed TDS had already been demonstrated, work was done on the design of a dry urine outlet valve with a hydraulic seal with the urine itself and a double-sealed ball valve.

However, work was also done on a dry urine outlet valve with a hydraulic seal with the urine itself and a single ball seal valve. It was demonstrated that this other preferred embodiment, also effectively fulfilled the objectives set out in the present description of the invention.

DETAILED DESCRIPTION OF THE INVENTION

As previously mentioned in the brief description of the invention, one of the preferred embodiments of the present invention consists of a three-seal valve to prevent the return of foul odors in a waterless urinal, in one of its preferred embodiments, the system has two types of seals. The first one is based on the formation of a column of liquid that retains the regression (back pressure) of foul odors coming from the pipe. The second one consists of mechanical seals being spheres which, by their own weight, seal off any foul odors which may be generated by the decomposing liquids contained in the liquid column. When the urine enters the cartridge, the spheres float by a difference in density allowing the liquid to pass into the water trap. As the urine is dislodged into the pipe, the spheres reseal maintaining a constant seal without foul odor.

In another of the preferred embodiment, the three-seal valve to prevent the return of foul odors in a waterless urinal, object of the present invention consists of the hydraulic seal formed by the urine itself with a ball seal on the top part.

This ball seal can consist of a chamber with a small ball that in its closed position rests on a horizontal seat, sealing the output gases generated in the lower chamber, consisting of a water trap.

But another second preferred embodiment of the above-mentioned, consists of a chamber with a lower ball seat and a lateral opening. When the sphere is in closed position, it seals with the side opening and the lower opening, achieving a double seal.

The detailed description will be based on the preferred embodiment illustrated in FIGS. 1 to 4.

Figure 1:
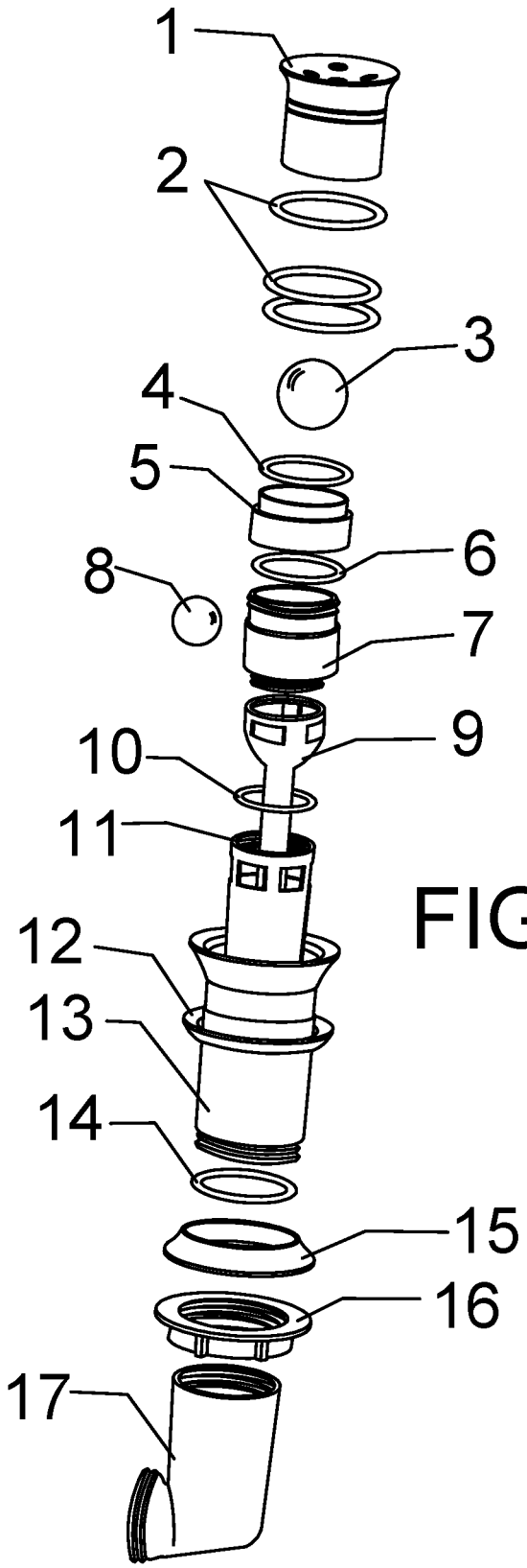
FIG. 1 illustrates an explosive or cutting view of the three-seal valve to prevent the return of foul odors in a waterless urinal, according to the object of the present invention.

FIG. 1 illustrates an explosive or cutting view of the three-seal valve to prevent the return of foul odors in a waterless urinal, object of the present invention.

The TDS 1 grid body is located up to the upper end, which is the body or element that, due to its dimension and conformation, as well as its distribution on the upper face, allows the flow of urine into the interior of the urinal outlet valve towards the drainage.

With this grill body 1 and the TDS sphere holder 5 that is screwed on the lower part of the grill body 1, the upper chamber is formed where a sphere 3 goes up and down due to the effect of the urine that reaches this chamber. When the sphere floats due to the accumulated urine, a downward flow of urine is formed until the chamber is emptied. When the chamber empties, the sphere 3 descends until it sits on the seat of the sphere holder 5 sealing and preventing the return of drainage gases.

A series of O-rings 2 and 4 are used for sealing between the different parts.

With the lower face of the ball carrier 5 and the inner space of the body 7, the TDS lower chamber is formed where a solid polypropylene ball TDS 7 can block the side hole and the lower hole, when there is no urine in the chamber, and unlock both holes when a certain volume of urine pushes the solid polypropylene sphere 8, and opens the passage to the funnel 9 of the hydraulic trap until the lower chamber 7 is completely discharged, in which case since the solid polypropylene sphere 8 is at the top of an inclined plane, rolls towards the bottom of that plane and simultaneously seals or blocks both holes blocking the exit of drainage gases and the gases naturally released by the urine in the reservoir of the hydraulic trap 11.

The hydraulic trap is thus formed by the tank of the hydraulic trap 11 and the funnel 9. The funnel 9 transports the urine to the bottom of the tank of the hydraulic trap and by means of the principle of communicating vessels establishes a flow of urine towards the edge of the tank to end up in the pipe that transports the urine to the drainage.

Figure 2:
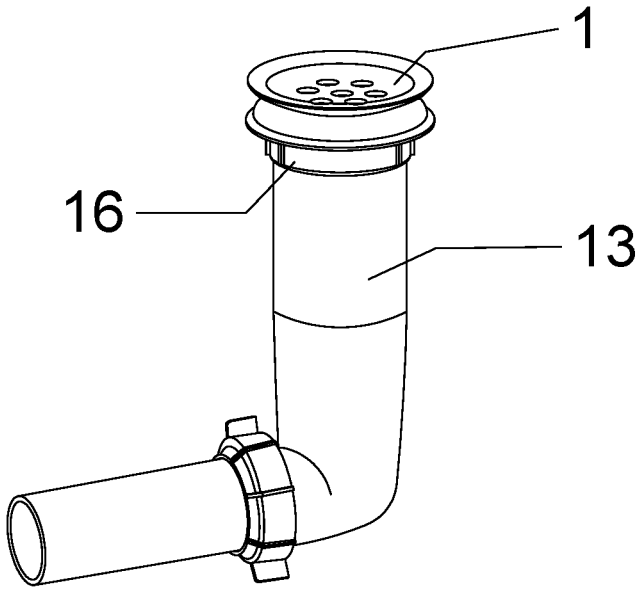
FIG. 2 illustrates the external appearance of the three-seal valve to prevent the return of foul odors in a waterless urinal, from FIG. 1.

FIG. 2 illustrates the external appearance of the three-seal valve to prevent foul odors from returning in a waterless urinal, from FIG. 1. In this figure, you can see the elements grid body 1, counter cartridge holder TDS 13 and counter-nut for a mgo/mgs device.

Figure 3:
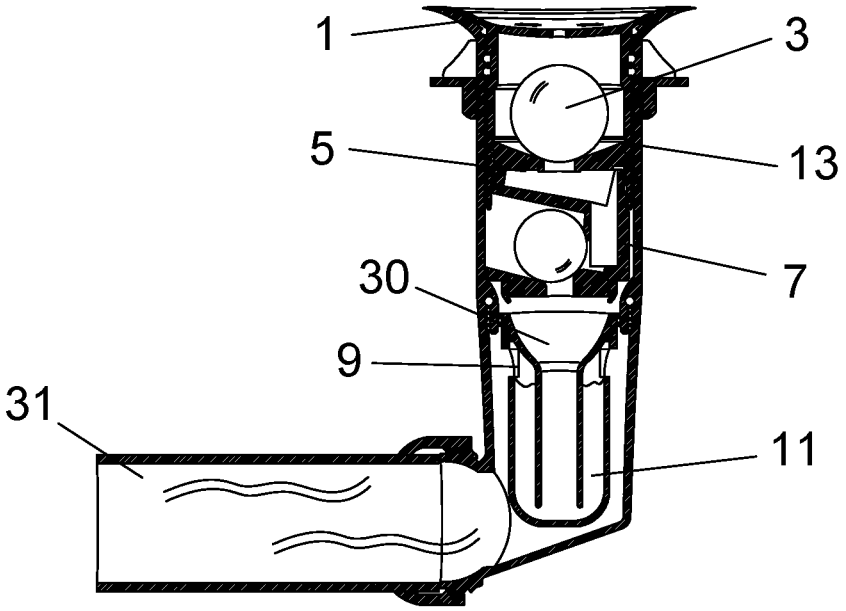
FIG. 3 illustrates a sectional view of the three-seal valve to prevent the return of foul odors in a waterless urinal, illustrated in FIGS. 1 and 2.

FIG. 3 illustrates a sectional view of the three-seal valve to prevent the return of foul odors in a waterless urinal, illustrated in FIGS. 1 and 2. In this sectional view it can be seen the grid body 1 with access to the upper chamber of the ball 3 with a ball seat 5. The grid body 1 is located in the counter-cartridge holder TDS 13 and in its lower part is located the lower chamber TDS 7 with the solid polypropylene sphere TDS 8. The funnel of the hydraulic trap 9 flows into the lower part of the tank 11 of the hydraulic trap.

Then the gases 31 from the drainage are stopped by the hydraulic trap and the gases 30 generated by the urine from the hydraulic trap are stopped by the mechanical seal which in this embodiment consists of a double ball valve.

Figure 4:
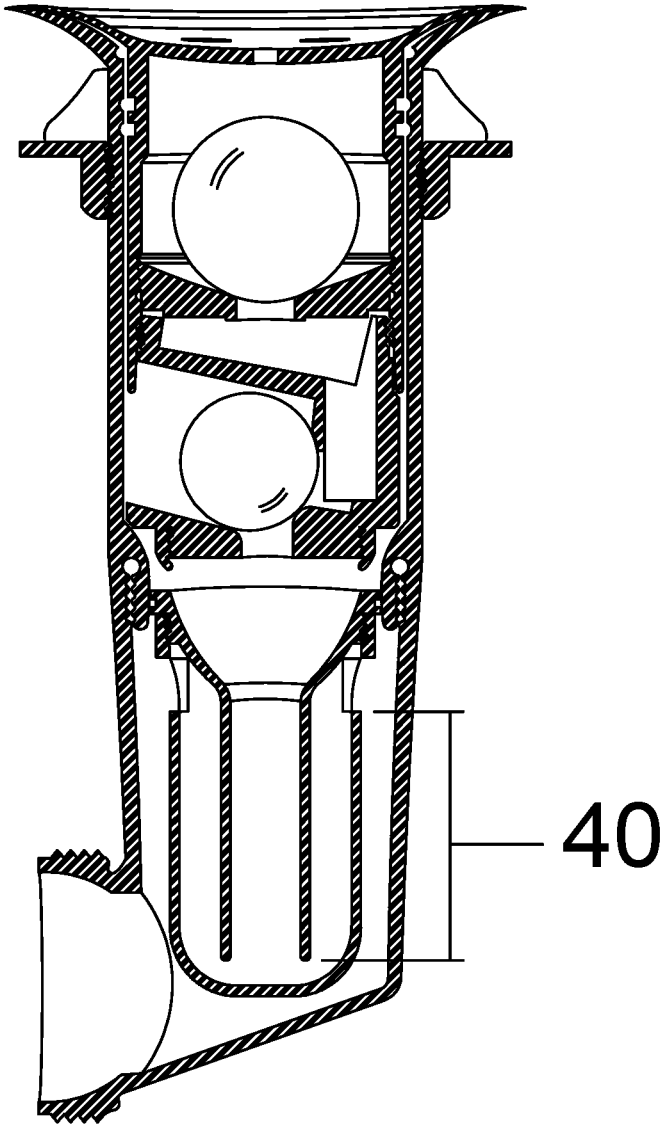
FIG. 4 shows the detail of the height of the water seal of the three-seal valve to avoid the return of foul odors in a waterless urinal, illustrated in FIG. 3.

FIG. 4 shows a detailed view of the height of the hydraulic seal of the three-seal valve to prevent the return of foul odors in a waterless urinal of FIG. 3. The detail is the height of the water column formed in the funnel, which is a height 40 corresponding to 4.7 cm. With this height, a compromise is achieved between a seal that must withstand 5 mbar of drainage gases and a compact design.

In summary, there are three preferred embodiments, all of which include the hydraulic trap. In one of the preferred embodiments of the outlet valve, in a waterless urinal of the present invention, two chambers are arranged above the water trap, an upper one with a ball seat and a ball forming a single ball valve. A lower chamber with two outlet holes, one lower and one lateral, is provided between the upper chamber and the water trap. In the closed position the sphere simultaneously blocks both holes, blocking the return of the gases released from the urine that forms the water trap.

In a second preferred embodiment, there is a single upper chamber, wherein this embodiment has in turn two preferred embodiments, one consisting of a chamber with a single sealing hole and the other option of a chamber with two sealing holes.

The invention has been described sufficiently so that a person with ordinary knowledge in the art can reproduce and obtain the results discussed in the present invention. However, any person skilled in the technological field covered by the present invention may be capable of making modifications not described in the present application; however, if in the application of these modifications for a given product or in the manufacturing process thereof, the subject matter claimed in the following claims is required, such structures shall be included within the scope of the invention.

The invention claimed is:

1. An outlet valve, in a waterless urinal, towards the drainage for preventing the return of foul odors comprising:

a valve with a chamber having a bottom opening located at a bottom of the chamber and a lateral opening located at a side of said chamber so that a sphere simultaneously blocks said bottom opening and said lateral opening in a closed position preventing the return of gases from a drainage; and a hydraulic trap formed by a funnel and a tank, wherein said hydraulic trap is provided below the valve so that the funnel receives urine from said valve and discharges said urine into a bottom of said tank.

2. The outlet valve according to claim 1, further comprising an upper valve provided above said valve and including an upper chamber having a bottom opening located at a bottom of the upper chamber so that an upper sphere blocks said bottom opening of the upper chamber in a closed position preventing the return of gases from said drainage.

3. The outlet valve according to claim 2, wherein said chamber is hydraulically and pneumatically connected below said upper chamber preventing the return of gases from said drainage.

4. The outlet valve according to claim 2, wherein the upper sphere unblocks said bottom opening of the upper chamber in an open position allowing a flow of urine through said bottom opening in order to be received at said funnel.

5. The outlet valve according to claim 2, wherein the upper sphere unblocks said bottom opening of the upper chamber in an open position allowing a flow of urine through said bottom opening in order to be received at said chamber; and said sphere simultaneously unblocks the bottom opening and the lateral opening of the chamber in an open position allowing a flow of said received urine through said bottom opening of the chamber so that said received urine is received at said funnel.

6. The outlet valve according to claim 1, wherein the sphere simultaneously unblocks said bottom opening and said lateral opening of the chamber in an open position allowing a flow of urine through said bottom opening and said lateral opening in order to be received at said funnel.

* * * * *